US005699588A

United States Patent [19]

Hsiung et al.

[11] Patent Number: 5,699,588

[45] Date of Patent: Dec. 23, 1997

[54] DEVICE OF REMOVING TRASH AND DUST FROM RAW COTTON BEFORE CARDING IN THE PREPARATORY BY APPLYING A HIGH-VOLTAGE STATIC ELECTRICITY

[75] Inventors: Han-Hsing Hsiung; Hsin-Hsiung Chiou; Sheng-Fu Chiu, all of Taipei, Taiwan

[73] Assignee: China Textile Institute, Taipei, Taiwan

[21] Appl. No.: 670,634

[22] Filed: Jun. 26, 1996

[51] Int. Cl.$^6$ ..... D01G 1/00; B03B 7/00

[52] U.S. Cl. ..... 19/66 R; 19/98; 19/200; 209/127.1; 209/129

[58] Field of Search ..... 19/200, 66 R; 209/127.1, 129, 12, 131

[56] References Cited

U.S. PATENT DOCUMENTS 5,327,617 7/1994 Yao ..... 19/200 X
5,432,980 7/1995 Yao ..... 19/200 X

*Primary Examiner*—John J. Calvert
*Attorney, Agent, or Firm*—Morton J. Rosenberg; David I. Klein

[57] ABSTRACT

A device is provided for applying a source of high-voltage static electricity in combination with suction to remove trash and dust from raw cotton in a preparation process before carding. The device includes a pair of plastic plates disposed on opposing ends of a housing. A pair of copper plates extend between the plastic plates and have a plurality of holes formed therethrough. The sources of static electricity are connected to the pair of copper plates and the raw cotton fibers are passed therebetween. A suction of 30–100 Pa is applied within the housing for removal of the trash and dust.

1 Claim, 2 Drawing Sheets

DEVICE OF REMOVING TRASH AND DUST FROM RAW COTTON BEFORE CARDING IN THE PREPARATORY BY APPLYING A HIGH-VOLTAGE STATIC ELECTRICITY

BACKGROUND OF THE INVENTION

The amount of trash contained in raw cotton plays an important part in determining the quality and appearance of ring-spun or OE-spun yarns. Quite often an uneven yarn is made due to a poor drawing occurring in the drawing process, as the amount of short fibers (shorter than 10 mm) in raw cotton is high. Further, a defect in produced yarns will be caused by uneven dyeing and sticky fibers that may exist during dyeing, because of a high trash content in the raw cotton.

In a rotor spinning system, yarn breakage may be serious and the spinning efficiency will be decreased due to a large amount of trash and dust contained in the processed slivers, which are intended to be stacked in the rotor groove during spinning. However, in a conventional spinning system, removal of trash and dust from raw cotton is often accomplished by using a mechanical force to open fiber tufts, which means that fiber damage will occur during such opening. Therefore, removal of trash and dust from raw cotton using non-mechanical force is not only of great concern for spinning but also a useful way of improving the quality of produced yarns.

Hence, the primary object of this invention is to provide a device for removing trash and dust from raw cotton in a preparatory process, before carding, by applying high-voltage static electricity to enhance the removal of trash and dust and by designing a method of non-mechanical fiber opening.

The structure and features of the present invention will be now described in detail with reference to the accompanying drawings.

DETAILED DESCRIPTION OF THE PREFERRED EMBODIMENTS

Figure 1:
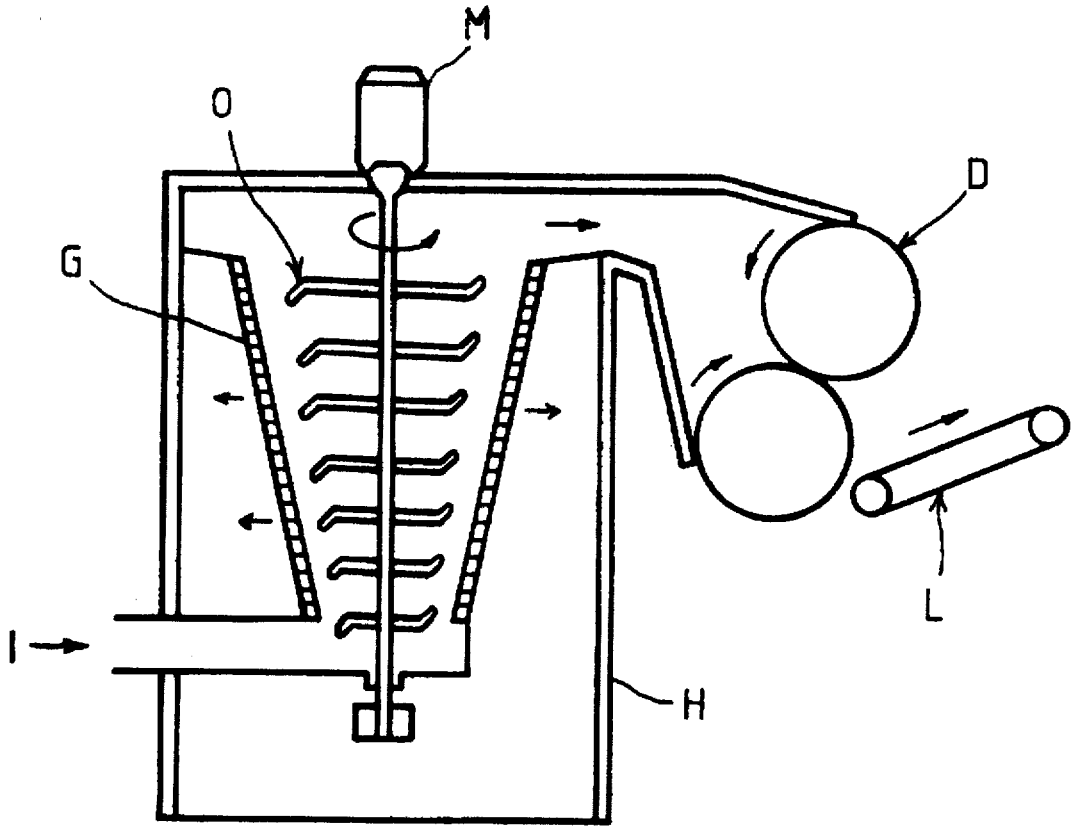
FIG. 1 (prior art)
FIG. 1 is a plan view of a prior known separating mechanism for removing trash using air flow (suction force)

As shown in FIG. 1, it can be seen that a known mechanism for separating trash and dust from fiber tufts is made by using the principle of air flow (suction force). The mechanism includes a housing (H) and a grind bar (G) mounted in the housing. A delivery cylinder (O) is placed in the center line of the grind bar and rotated by a motor (M). A dust gauge (D) is formed at one side of the housing while a delivery device (L) is provided beside the dust gauge. As fiber tufts are put into an inlet (I), the mechanism will separate trash and dust from fiber tufts by the force of air flow. In this conventional system, although the fiber tufts are effectively opened during the separation process, the removal of trash and dust from raw cotton is still not good enough for subsequent processes. Further, this conventional preparatory process is likely to damage fibers because of the use of a beater for opening fiber tufts.

Figure 2:
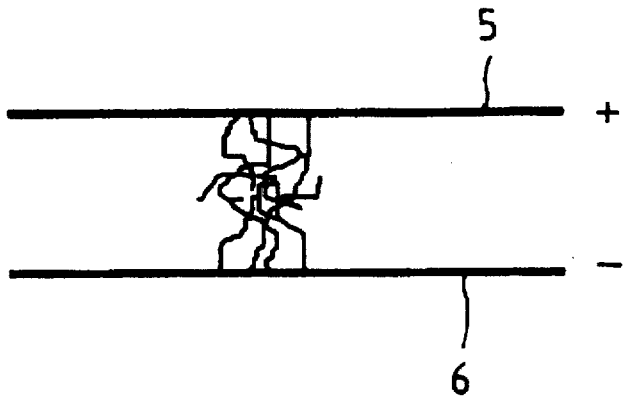
FIG. 2 shows the behavior of fiber tufts between two copper plates.

The purpose of this invention is therefore to design a new method of fiber opening and improve the removal of trash and dust from fiber tufts processed in the fiber opening process. The removal of trash and dust from raw cotton that is expected in the present invention is obtained by applying high-voltage static electricity for fiber opening. FIG. 2 shows the behavior of fiber tufts when they pass between two copper plates with high-voltage static electricity applied therebetween, the fiber tufts being well opened. The device of this invention also combines air suction to achieve trash and dust removal.

Figure 3:
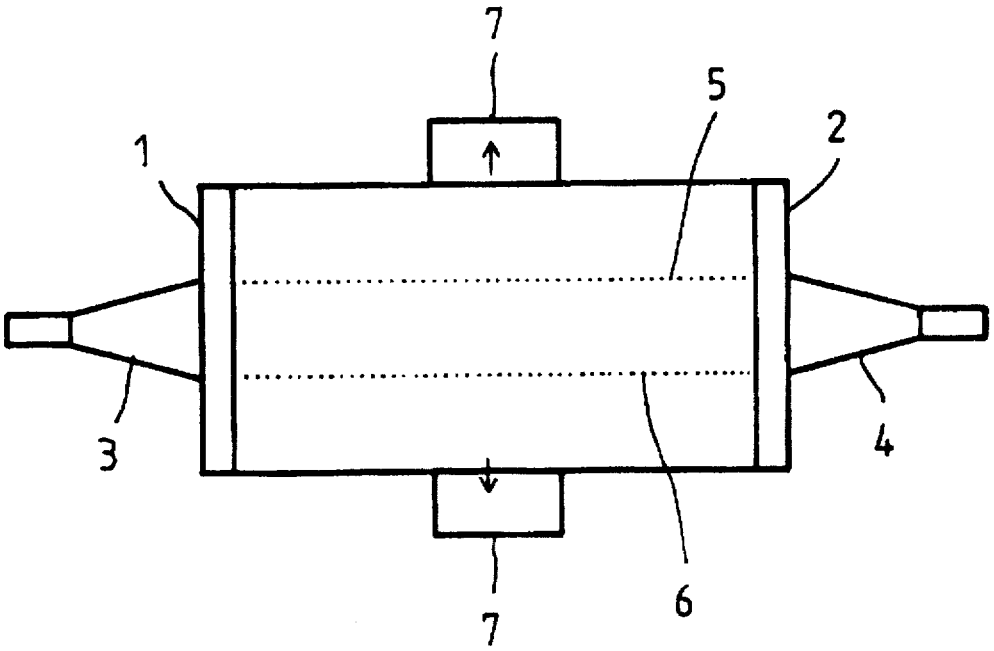
FIG. 3 is a plan view of the device mechanism according to the present invention.

Accordingly, the general device mechanism of the present invention is shown as in FIG. 3. It includes two non-conducted plastic plates (1), (2) with related outward trumpet-shaped inlet (3) and trumpet-shaped outlet (4). Two parallel copper plates (5), (6) which contain many punched holes are mounted between the plastic plates (1), (2). Two suction pumps (7) provided on top and bottom sides of the device are connected to an air duct and are the exits for the trash and dust. The thickness of the copper plates is between 1–5 mm and the punched holes in the copper plates have a diameter of 4–8 mm. A gauge of 5–15 cm between the two copper plates is set and a 30–60 kV source of static electricity is used as the power supply therefor. A suction power with a 30–100 Pa can be applied for removing trash and dust from the raw cotton. When the fiber flow comes into a high-voltage static electricity field form the trumpet-shaped inlet and exits from the device through the trumpet-shaped outlet to a carding machine, there will be a large relationship between the amount of trash and dust removed and the amount of suction used.

In order to show the improvements provided by this invention, Pakistani's raw cotton with a 5% trash content has been used for analyzing the amount of trash and dust removed, the results of the experiments made are listed in Table 1. It is obvious that the efficiency of removing trash and dust can be greater than 50% with use of a 30 kV source of static electricity and 50 Pa of suction power applied.

TABLE 1

Analysis of trash removal (30 kV) source of static electricity used)

| | Before testing | Suction (50 Pa) | Suction (60 Pa) | Suction (70 Pa) |
|---|---|---|---|---|
| Trash content (%) | 3.349 | 1.596 | 1.490 | 1.304 |
| % of trash removing | — | 52.3 | 55.5 | 61.1 |

What I claimed is:

1. A device for removing trash and dust from raw cotton before carding, comprising:

a longitudinally extended housing;

a pair of non-conductive plastic plates disposed on opposing longitudinal end of said housing, one of said pair of plastic plates having a trumpet-shaped inlet and the other of said pair of plastic plates having a trumpet-shaped outlet for passing raw cotton therethrough;

a pair of copper plates extending longitudinally within said housing between said pair of plastic plates in spaced parallel relationship, said pair of copper plates being spaced one from the other within an approximating range of 5–15 cm, each of said pair of copper plates having a plurality of holes formed therethrough, each of said plurality of holes having a diameter within an approximating range of 4–8 mm and each of said pair of copper plates having a thickness in an approximating range of 1–5 mm;

a source of static electricity connected between said pair of copper plates, said source of static electricity having a voltage within an approximating range of 30–60 kV; and, a pair of suction pumps connected respectively to an upper and a lower portion of said housing, said pair of suction pumps providing a suction in an approximating range of 30–100 Pa for removing trash and dust from the raw cotton.

* * * * *